US007591394B1

(12) United States Patent
Shingle

(10) Patent No.: US 7,591,394 B1
(45) Date of Patent: Sep. 22, 2009

(54) CHILD-RESISTANT PACKAGE, CLOSURE AND CONTAINER

(75) Inventor: John M. Shingle, Perrysburg, OH (US)

(73) Assignee: Rexam Prescription Products Inc., Perrysburg, OH (US)

( * ) Notice: Subject to any disclaimer, the term of this patent is extended or adjusted under 35 U.S.C. 154(b) by 320 days.

(21) Appl. No.: 11/129,245

(22) Filed: May 12, 2005

(51) Int. Cl.
*B65D 39/00* (2006.01)
*B65D 41/16* (2006.01)

(52) U.S. Cl. ..... 220/789; 220/787; 220/780

(58) Field of Classification Search ..... 220/780, 220/781, 784, 788, 296, 293, 691, 682, 345.2, 220/345.1, 789, 787, 794, 792, 802, 801, 220/800, 799; 215/321, 318, 209, 44, 43, 215/224, 46, 45, 305, 296, 295, 355, 320, 215/317; 206/515, 505, 499; 229/404, 400
See application file for complete search history.

(56) References Cited

U.S. PATENT DOCUMENTS 1,761,603 A * 6/1930 Wainwright ..... 220/254.7
2,047,281 A * 7/1936 Merolle ..... 215/320
2,154,118 A * 4/1939 Ames ..... 220/293
2,365,737 A * 12/1944 White ..... 215/346
2,563,352 A * 8/1951 Morse ..... 206/515
2,754,866 A * 7/1956 Coltman, Jr. ..... 220/254.3
2,990,076 A * 6/1961 Stull ..... 215/46
3,100,589 A * 8/1963 Love, Jr. ..... 222/480
3,105,621 A * 10/1963 Francis ..... 222/498
3,136,439 A * 6/1964 Kuehn ..... 215/295
3,159,305 A * 12/1964 Fischbach ..... 220/789
3,189,072 A * 6/1965 Starr ..... 215/321
3,215,300 A 11/1965 Lynch
3,360,152 A * 12/1967 Leers ..... 220/4.24
3,398,848 A * 8/1968 Donovan ..... 215/224
3,630,403 A * 12/1971 Berg ..... 215/221
3,667,637 A * 6/1972 Bagguley et al. ..... 215/225
3,815,770 A * 6/1974 Guala ..... 215/253
3,830,393 A * 8/1974 Schaefer ..... 215/209
3,991,895 A * 11/1976 Thornton ..... 215/211
4,135,512 A 1/1979 Godsey
4,209,100 A 6/1980 Uhlig
4,397,397 A * 8/1983 Herr ..... 215/211
4,406,376 A * 9/1983 Berghahn ..... 215/224
4,423,822 A * 1/1984 Powalowski ..... 215/365
4,449,639 A * 5/1984 Davis ..... 215/224
4,457,437 A * 7/1984 Heath, Jr. ..... 215/224
4,524,876 A * 6/1985 Kusz ..... 215/224

(Continued)

FOREIGN PATENT DOCUMENTS

JP 05085582 A * 4/1993

*Primary Examiner*—Anthony D Stashick
*Assistant Examiner*—Robert J Hicks
(74) *Attorney, Agent, or Firm*—Reising Ethington PC

(57) ABSTRACT

A child-resistant package includes a container having an open mouth surrounded by a wall and a closure engagement element extending circumferentially part-way but not completely around the wall. The portion of the wall into which the engagement element does not extend is resiliently inwardly flexible. A closure has a base portion that engages an end of the container wall around the mouth and an engagement portion that engages the engagement element on the container wall. The portion of the container wall that is inwardly flexible permits manual engagement with the base portion of the closure to remove the closure from the container.

14 Claims, 3 Drawing Sheets

U.S. PATENT DOCUMENTS 4,526,281 A * 7/1985 Herr ..... 215/211
4,657,141 A 4/1987 Sorensen
4,671,421 A * 6/1987 Reiber et al. ..... 215/228
4,755,342 A * 7/1988 Biermann ..... 264/523
4,940,167 A 7/1990 Fillmore et al.
5,031,784 A 7/1991 Wright
5,038,454 A 8/1991 Thornock et al.
5,125,512 A 6/1992 O'Leary
5,137,260 A 8/1992 Pehr
5,180,072 A * 1/1993 Oehlert ..... 215/209
5,292,017 A * 3/1994 Reifers ..... 215/206
5,383,564 A 1/1995 Hamilton et al.
5,618,004 A 4/1997 Klearman et al.
6,170,710 B1 1/2001 Suffa
6,612,450 B1 * 9/2003 Buono ..... 215/228
7,185,776 B1 * 3/2007 Konefal ..... 215/228
2002/0148846 A1 * 10/2002 Luburic ..... 220/792
2003/0085228 A1 * 5/2003 Oakes ..... 220/302
2004/0178165 A1 * 9/2004 Konefal et al. ..... 215/222
2005/0263477 A1 * 12/2005 Konefal et al. ..... 215/228

* cited by examiner

CHILD-RESISTANT PACKAGE, CLOSURE AND CONTAINER

The present disclosure relates to child-resistant packages, such as prescription packages for example, and to closures and containers for such packages.

BACKGROUND AND SUMMARY OF THE DISCLOSURE

The present disclosure involves a number of aspects that can be implemented separately from or in combination with each other.

A child-resistant package, in accordance with a first aspect of the present disclosure, includes a container having an open mouth surrounded by a wall and a closure engagement element extending circumferentially part-way but not completely around the wall. The portion of the wall into which the engagement element does not extend is resiliently inwardly flexible. A closure has a base portion that engages an end of the container wall around the mouth and an engagement portion that engages the engagement element on the container wall. The portion of the container wall that is inwardly flexible permits manual engagement with the base portion of the closure to remove the closure from the container. In an exemplary embodiment according to this aspect of the disclosure, the engagement element on the container includes an internal bead, and the closure includes an annular wall extending from the base portion of the closure with an external bead for snap-engagement over the internal bead on the container wall. Thus, to open the package in a child-resistant mode of operation, the portion of the container wall in which the internal bead is absent is pressed radially inwardly to enable manual engagement with an undersurface of the base portion of the closure, and the closure is then pushed away from the container to disengage the respective beads.

In accordance with another aspect of the disclosure, the closure and container are adapted for a non-child-resistant mode of operation by providing an internal bead around the open mouth of the container and a peripheral bead around the base portion of the closure. The closure thus may be inverted so that the peripheral bead on the closure base portion can be received by snap-fit over the internal bead around the container mouth. In accordance with a third aspect of the disclosure, the container is configured to facilitate stacking of containers in an automatic prescription filling system, for example. The container sidewall has an upper cylindrical portion on which at least one closure engagement element is disposed and a lower conical portion extending from the cylindrical portion. The cylindrical portion is radially outwardly offset from the conical portion, so that the conical portions of the containers can be nested one within another with the cylindrical portions in stacked engagement to facilitate removal.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 3:
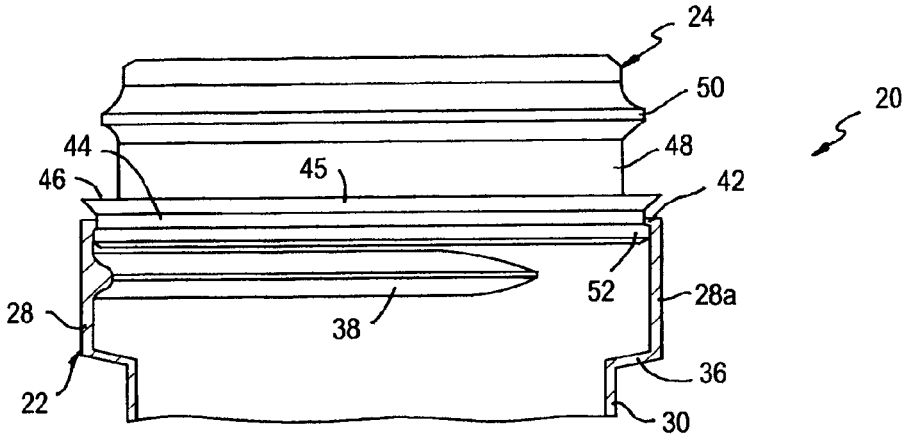
FIG. 3 is a fragmentary partially sectioned elevational view of the package in FIG. 1 in a non-child-resistant mode of operation.
Figure 1:
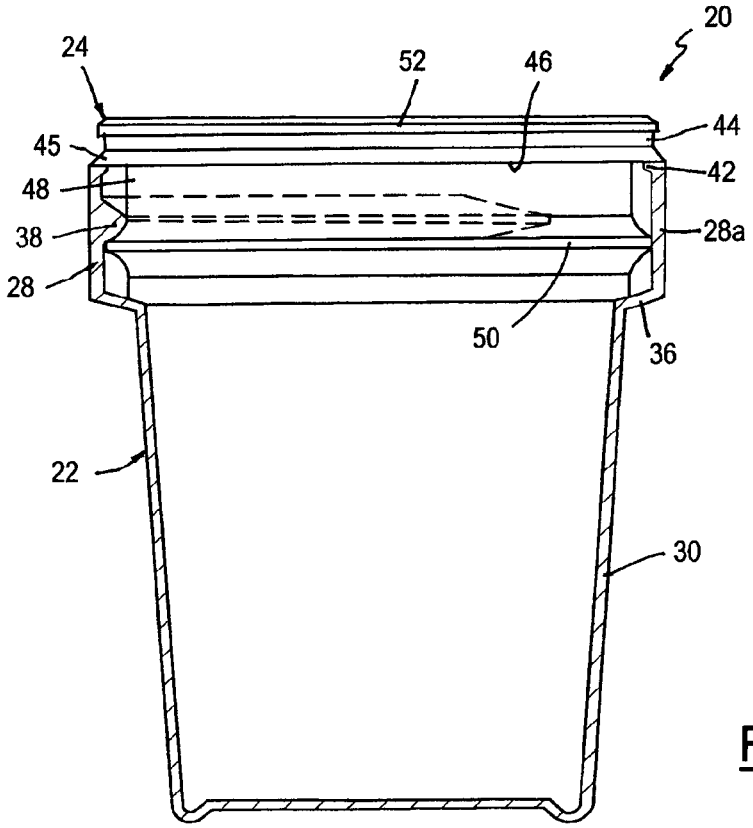
FIG. 1 is a partially sectioned elevational view of a package in accordance with one exemplary embodiment of the present disclosure.
Figure 2:
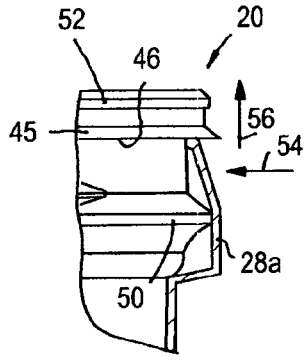
FIG. 2 is a fragmentary partially sectioned elevational view of a portion of the package in FIG. 1 during removal of the closure.
Figure 5:
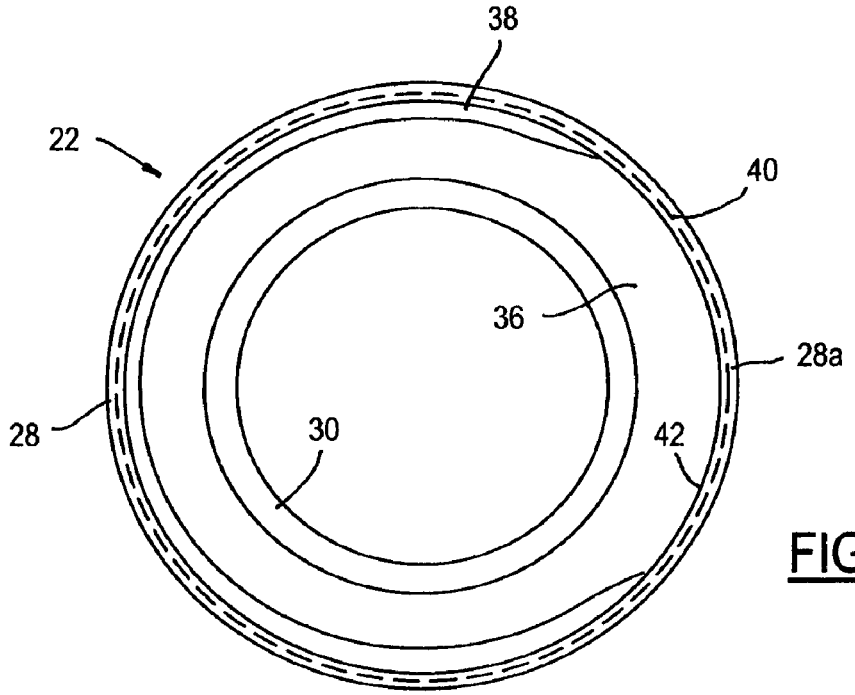
FIG. 5 is a top plan view of the container in FIG. 4, being taken from the direction 5 in FIG. 4.
Figure 4:
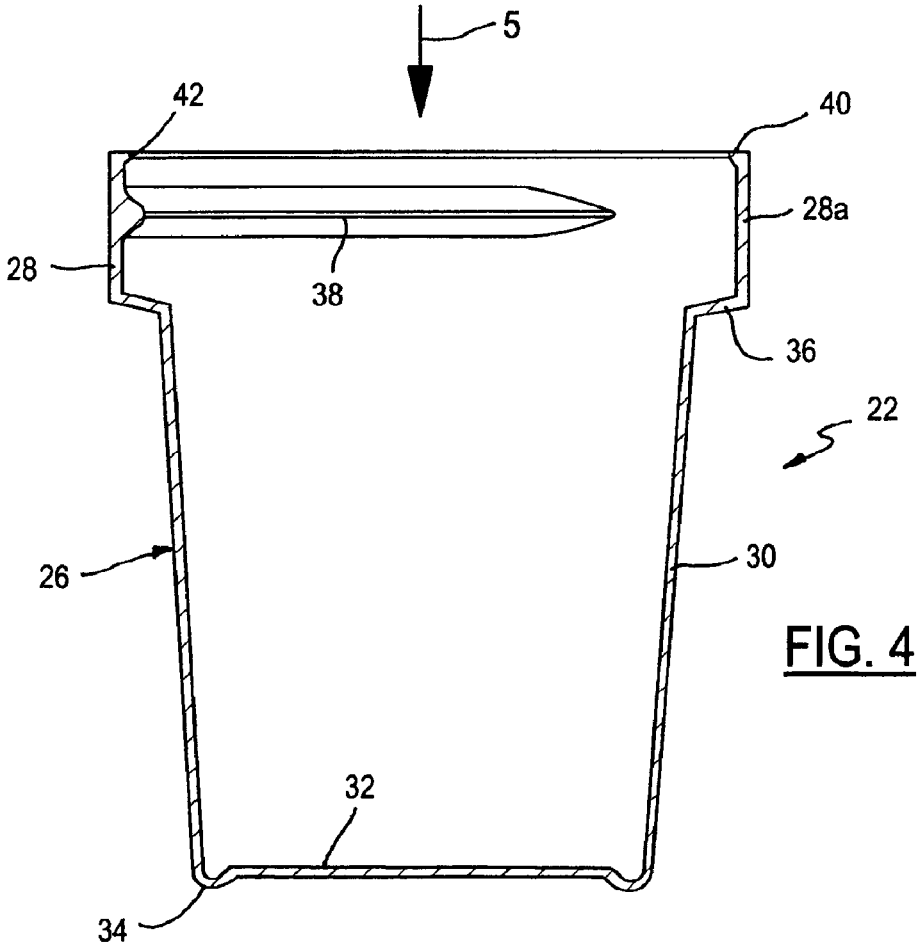
FIG. 4 is a sectioned elevational view of the container in the package of FIGS. 1-3.

FIGS. 1-3 illustrate a package 20, in accordance with an exemplary embodiment of the invention, as including a container 22 to which a closure 24 is removably secured. Referring also to FIGS. 4-5, container 22 includes a sidewall 26 having a first section 28 surrounding the open mouth of the container and a second section 30 spaced from the open mouth of the container. First sidewall section 28 preferably is substantially cylindrical, while second sidewall section 30 preferably is frustoconical. Container 22 also has a base 32, preferably a push-up base connected to sidewall section 30 by a rounded chime 34. Container 22, including sidewall sections 28, 30 and base 32, preferably is of one-piece integrally molded plastic construction. Sidewall section 28 preferably is radially outwardly offset from sidewall section 30, being coaxial with sidewall section 30 and integrally connected thereto by a contiguous shoulder portion 36.

At least one closure engagement element is disposed on container sidewall section 28 for securement of closure 24 (FIGS. 1-3). In the illustrated exemplary embodiment of the disclosure, this closure engagement element includes an internal bead 38 on container sidewall section 28. As best seen in FIGS. 4 and 5, bead 28 extends circumferentially part-way but not completely around the inside surface of sidewall section 28. The portion 28*a* of sidewall section 28 into which bead 38 does not extend is resiliently radially inwardly flexible, inasmuch as bead 38 does not extend into this sidewall portion to strengthen the sidewall portion against inward flexure. Bead 38 preferably is circumferentially continuous, except of course at sidewall portion 28*a*, but could be circumferentially discontinuous if desired. In the illustrated exemplary embodiment of the disclosure, bead 38 extends around approximately 270° of sidewall section 28, with portion 28*a* constituting about 90° of the total sidewall section. These figures are exemplary. The upper edge 40 of sidewall section 28 preferably lies in a plane perpendicular to the axis of container sidewall 26.

In the illustrated exemplary embodiment of the disclosure, there is an internal bead 42 that extends around the container mouth at the upper edge of sidewall section 28. (Directional words such as "axial" and "radial" are employed by way of description and not limitation with respect to the central axis of the container or the closure as appropriate. Directional words such as "upper" and "lower" are employed by way of description and not limitation with respect to the upright orientation of the package, container and closure illustrated in the drawings.) As will be described, this internal bead 42 preferably is provided to facilitate a non-child-resistant mode of operation of package 20. Although bead 42 is provided in the preferred exemplary embodiment of the disclosure, bead 42 is not necessary in accordance with all aspects of the present disclosure. Bead 42, when provided, can be circumferentially continuous, as shown, or circumferentially discontinuous.

Closure 24 (FIGS. 1-3 and 7) includes a base portion 44, which preferably is flat and circular in geometry. Base portion 44 has a radially outwardly extending flange 45 with an undersurface 46, which preferably is annular and flat, extending around the periphery of base portion 44 in the illustrated preferred embodiment of the disclosure. The outer diameter of flange 45 and undersurface 46 preferably is not greater than the outer diameter of the open container mouth—i.e., the outer diameter of the upper edge of container wall section 28. An annular wall 48 extends from the inner periphery of undersurface 46 and preferably is coaxial with the outer periphery of base portion 44. An external bead 50 is provided on annular wall 48 at a spacing from undersurface 46 suitable for snap-fit over bead 38 (FIGS. 1 and 4-5) in assembly of closure 24 to container 22 in a child-resistant mode of operation (FIGS. 1-2). A peripheral bead 52 preferably is provided around base portion 44 of closure 24. Closure 24 preferably is hollow within annular wall 48, and preferably is of one-piece integrally molded plastic construction.

In a child-resistant mode of operation illustrated in FIGS. 1 and 2, closure 24 is secured to container 22 with annular wall 48 received within the container mouth and closure bead 50 received by snap-fit over container bead 38. Bead 50 has an outside diameter for primary plug-sealing engagement within wall section 28. Flat undersurface 46 of closure base portion 44 is in secondary sealing engagement with upper edge 40 of container sidewall portion 28. To remove closure 24, container wall portion **28*a* is pushed radially inwardly in the direction 54 in FIG. 2, which then permits manual engagement with a portion of closure undersurface 46. The closure is then pushed axially in the direction 56 until beads 38, 50 disengage and the closure can be removed from the container. Suitable indicia may be provided on sidewall 22 to inform a user where to push sidewall portion 28*a*, and indicia may be molded or otherwise provided on the top surface of closure 24 to inform a user how to open the package. The requirement for two perpendicular motions—i.e., radially inward motion of container wall portion 28*a* and then axial movement against closure undersurface 46**—provides the child resistance. The package thus provides a snap-cap-type child-resistant mode of operation.

In the preferred embodiment of the disclosure, anon-child-resistant mode of operation is provided by peripheral bead 52 on closure base portion 44 and internal bead 42 around the container mouth. That is, closure 24 is inverted (FIG. 3, as compared with FIGS. 1-2) and secured to the container by snap-fit of closure peripheral bead 52 over container internal bead 42. In the non-child-resistant mode of operation, therefore, the exemplary embodiment of the disclosure operates as a simple snap-cap. Suitable indicia can be molded or otherwise provided on the undersurface of base portion 44 within annular wall 48, for example, to advise a user that the package is non-child-resistant in the configuration of FIG. 3. Sealing engagement in the non-child-resistant mode of operation is provided by contact between closure bead 52 and the inner surface of wall section 28, and contact between container bead 42 and the outer surface of closure wall 44.

Figure 6:
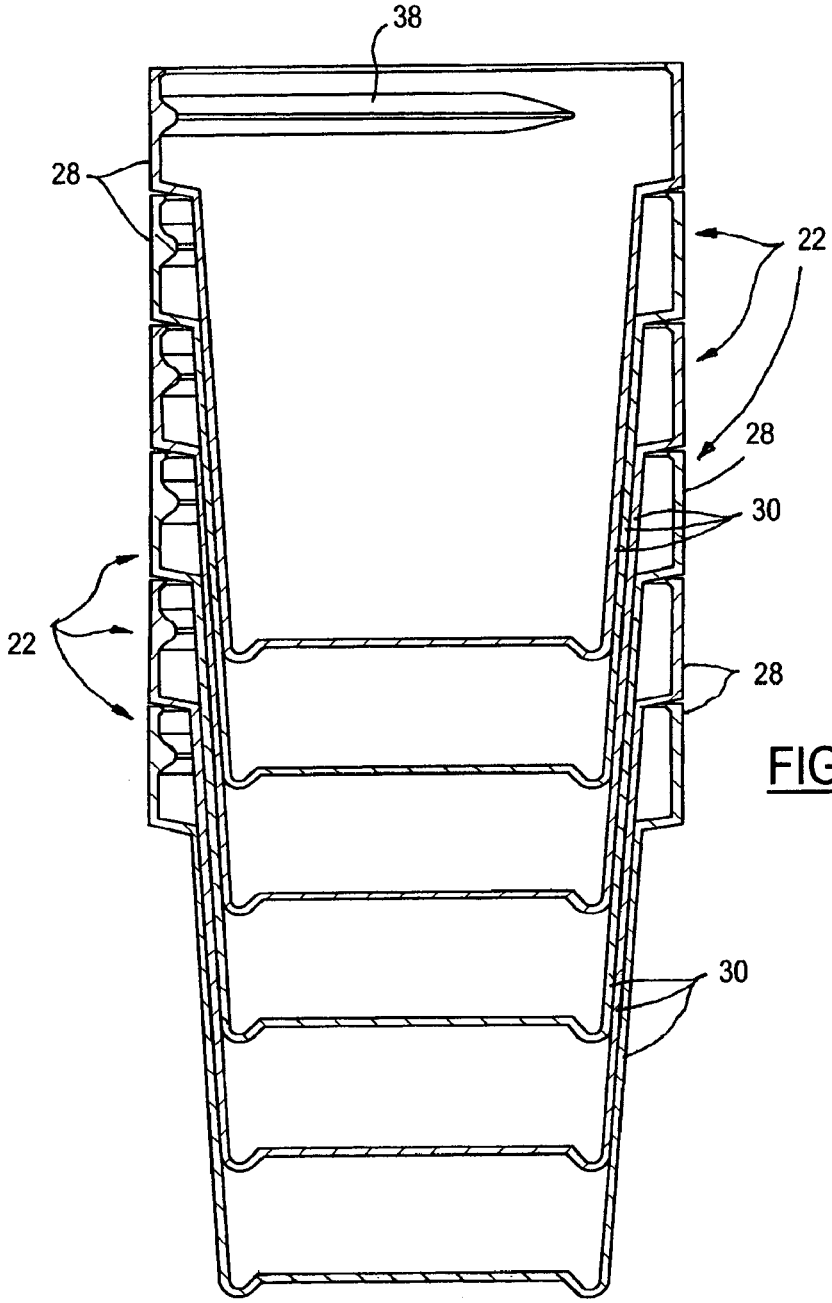
FIG. 6 is a sectioned elevational view of a stack of containers of the type illustrated in FIGS. 4-5.
Figure 7:
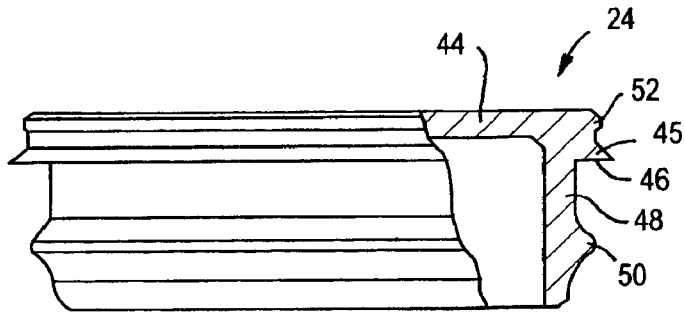
FIG. 7 is a partially sectioned elevational view of the closure in the package of FIGS. 1-3.

As shown in FIG. 6, the preferred geometry of container 22 is such that the containers can be stacked one within another, with conical wall sections 22 nested within each other and cylindrical wall sections 28 in abutting end-to-end engagement. This container stacking aspect of the present disclosure is particularly useful in connection with automatic prescription filling machines.

There thus have been disclosed a package, a container and a closure that fully satisfy all of the objects and aims previously set forth. The disclosure has been presented in conjunction with a presently preferred embodiment, and a number of modifications and variations have been discussed. Other modifications and variations readily will suggest themselves to persons of ordinary skill in the art in view of the foregoing description. The disclosure is intended to embrace all such modifications and variations as fall within the spirit and broad scope of the appended claims.

What is claimed is:

1. A child-resistant package that includes:

a container having an open mouth surrounded by a wall and a closure engagement element extending circumferentially part-way but not completely around said wall, a portion of said wall into which said engagement element does not extend being resiliently inwardly flexible, and a closure having a base portion that engages an end of said mouth and an engagement portion that engages said engagement element on said wall, said portion of said wall being inwardly flexible to permit manual engagement with said base portion of said closure for removal of said closure by disengagement between said engagement portion of said closure and said engagement element on said container.

2. The package set forth in claim 1 wherein said engagement element on said container is disposed on an inside surface of said wall.

3. The package set forth in claim 2 wherein said engagement element comprises an internal bead on said wall.

4. The package set forth in claim 3 wherein said bead is circumferentially continuous except at said portion of said wall.

5. The package set forth in claim 3 wherein said engagement portion of said closure includes an annular wall extending from said base portion and an external bead on said annular wall.

6. The package set forth in claim 5 wherein said external bead is circumferentially continuous.

7. The package set forth in claim 5 wherein said closure is hollow within said annular wall.

8. The package set forth in claim 1 wherein said wall on said container has an internal bead, and wherein said base portion of said closure has an external bead for a snap-receipt over said internal bead in an inverted non-child-resistant mode of operation of said closure.

9. The package set forth in claim 1 wherein said container wall has a first section adjacent to said mouth and a second section spaced from said mouth, said first section of said wall being radially outwardly offset from said second section to facilitate nested stacking of the containers.

10. The package set forth in claim 9 wherein said first section of said wall is cylindrical and said second section of said wall is frustoconical.

11. A child-resistant package that includes:

a container having an open mouth surrounded by a wall with a first internal bead around said mouth and a second internal bead spaced from said mouth, said second internal bead extending part-way but not completely around said wall, a portion of said wall into which said second internal bead does not extend being resiliently inwardly flexible, and a closure having a base portion with a flat undersurface that engages an end of said first wall portion around said mouth, a first external bead on said base portion, an annular wall that extends from said undersurface and a second external bead on said annular wall, said second external bead on said annular wall being receivable by snap-fit over said second internal bead on said container wall to secure said closure to said container in a child-resistant mode of operation of said package, said portion of said wall being inwardly flexible to permit manual engagement with said undersurface of said base portion for removal of said closure, said first external bead on said closure base portion being receivable by snap-fit over said first internal bead on said container wall in an inverted non-child-resistant mode of operation of said package.

12. The package set forth in claim 11 wherein said second internal bead on said wall is circumferentially continuous except at said portion of said wall.

13. The package set forth in claim 11 wherein said container wall has a first section adjacent to said mouth and a second section spaced from said mouth, said first section of said wall being radially outwardly offset from said second section to facilitate nested stacking of the containers.

14. The package set forth in claim 13 wherein said first section of said wall is cylindrical and said second section of said wall is frustoconical.

* * * * *